United States Patent [19]

Neuhardt

[11] 4,114,337

[45] Sep. 19, 1978

[54] WASTED SPACER MEMBER FOR WALL ELEMENTS, ESPECIALLY FOR GLASS BRICKS

[76] Inventor: Walther C. Neuhardt, Lerchenfelderstrasse 130/7, Vienna, Austria, 1080

[21] Appl. No.: 747,874

[22] Filed: Dec. 6, 1976

[30] Foreign Application Priority Data

Dec. 15, 1975 [AT] Austria ..... 9490/75

[51] Int. Cl.[2] ..... E04B 2/00

[52] U.S. Cl. ..... 52/442; 52/100; 52/306

[58] Field of Search ..... 52/306, 426, 428, 562, 52/565, 431, 100, 582, 442

[56] References Cited

U.S. PATENT DOCUMENTS

| | | | |
|---|---|---|---|
| 1,053,231 | 2/1913 | Schweikert | 52/426 |
| 2,029,082 | 1/1936 | Odam | 52/426 X |
| 2,921,462 | 1/1960 | Wilson | 52/426 X |

*Primary Examiner*—Price C. Faw, Jr.
*Assistant Examiner*—Carl D. Friedman
*Attorney, Agent, or Firm*—John J. Dennemeyer

[57] ABSTRACT

A wasted spacer member for wall elements consists of cross-shaped and T-shaped members each composed of two elements whose face planes are parallel to each other, and the intersecting point of their arms lies on a common axis perpendicular to the face planes. The two elements of the spacer member are connected to each other by at least one web member of such a length that the distance between the two outer surfaces of the spacer member is less than the thickness of the wall elements and the width or thickness of the arms measured in the planes of the elements corresponds either to the joint width between the individual wall elements or to the joint width plus the sum of the groove depths of two adjacent wall elements.

22 Claims, 7 Drawing Figures

WASTED SPACER MEMBER FOR WALL ELEMENTS, ESPECIALLY FOR GLASS BRICKS

Figure 1:
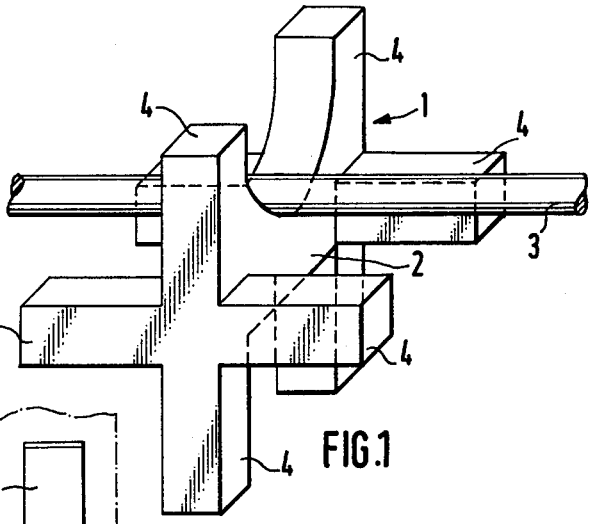

The invention relates to a wasted spacer member for wall elements, especially for glass bricks, consisting of at least one cross-element or T-element whose arms are disposed in two planes that are perpendicular to each other.

The placing of wall elements, especially of glass bricks, is carried out in such a way that a first layer of bricks is put in place and short wooden strips are used to provide a spacing between the adjacent wall blocks or bricks. Thereafter narrow planed wooden strips are put on so as to obtain a uniform spacing of the next layer, and between these wooden strips the mortar and a reinforcing bar is put, the wall elements for the next layer being placed on top of the wooden strips. After the wall is finished and the mortar has hardened the wooden strips are removed, but this causes usually a destruction of the wooden strips. After the wooden strips have been removed the grooves thus created are filled in with a joint mortar. It is obvious that in this known working procedure the wooden strips must be kept in the brick construction until the mortar has hardened as otherwise the wall would settle unevenly whereby the good visual impression of the wall construction would be destroyed. It is clear that when the mortar is hard it is very difficult to remove the wooden strips because the mortar sticks to them, and when a chisel is used to help remove them this is likely to cause damage to the bricks. In any case, even when a special mortar is used a subsequent filling out of the joints is necessary.

It is an object of the present invention to provide a spacer member for wall elements, especially for glass bricks, which makes possible a working operation that eliminates the above mentioned disadvantages. This is obtained according to the invention in that the spacer member consists of two cross-elements or T-elements which lie in parallel planes to each other, wherein the intersecting points of the arms of both elements lie on a common axis which is perpendicular to the plane of the elements, that the two elements are joined to each other by at least one web, wherein the distance between the two outer surfaces of the elements from each other is smaller than the thickness of the wall elements, and the width (thickness) of the arms measured in the planes of the elements corresponds either to the width of the joints between the individual wall elements or the width of the joint plus the sum of the groove depths of two adjacent wall elements. The spacer members of the invention are imbedded into the mortar and as they are set back relative to the surface of the bricks they can remain in place. It is also possible to finish the constructed wall directly after the placing of the last layer or, when using a visible joint mortar, to finish it simultaneously with the placing of the bricks. This produces a considerable saving of time with regard to the known working procedure because in the conventional procedure the filling out of the joints may be carried out only one or two days after the wall is built so that the workers are forced to go twice to the same construction site. A further advantage of the spacer member according to the invention consists in that the correct vertical as well as horizontal distance between adjacent elements can be assured with a single spacer member while in the known working procedure at least two strips are necessary which must be removed subsequently.

The web according to the spacer member of the invention is designed in a preferred embodiment as a support element for the iron reinforcing bars which are placed between the wall elements, wherein the surface of the web supporting the reinforcing bar is displaced relative to the intersecting point of the arms of the cross-element or T-element by half the diameter of the reinforcing bar whereby the strength properties of the wall with reinforcing bars is improved.

In a particularly advantageous embodiment of the spacer member the cross-elements or T-elements are provided with break-off vanes which enclose the wall elements, or with a disc which encloses the outer surfaces of the wall element, wherein the distance of the discs enclosing the outer surfaces of the wall elements or the vertical parts of two oppositely disposed break-off vanes correspond to the thickness of the wall element. This arrangement guarantees not only an exact maintenance of the joint width but prevents simultaneously that one wall element is set back relative to an adjacent wall element so that an even wall is produced. These break-off vanes may be broken off simply with a spatula or a trowel as soon as the mortar is hardened a little and therefore do not get in the way during the filling of the joints, which is always necessary.

According to a preferred embodiment of the invention the discs are releasably connected with the cross-elements or T-elements so that they may be repeatedly used in contrast to the cross-elements or T-elements.

According to an additional feature of the invention the spacer member consists of a material which is essentially not subject to expansion in water and preferably of a synthetic material containing filler materials.

Figure 3:
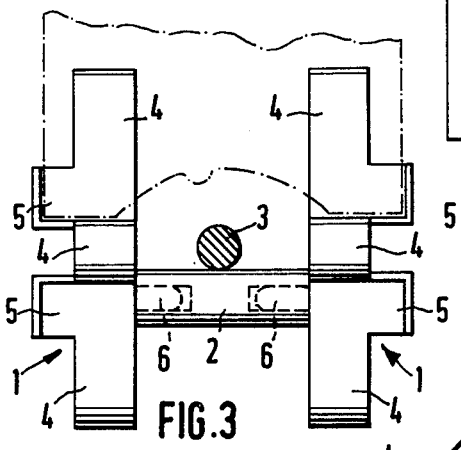
Figure 2:
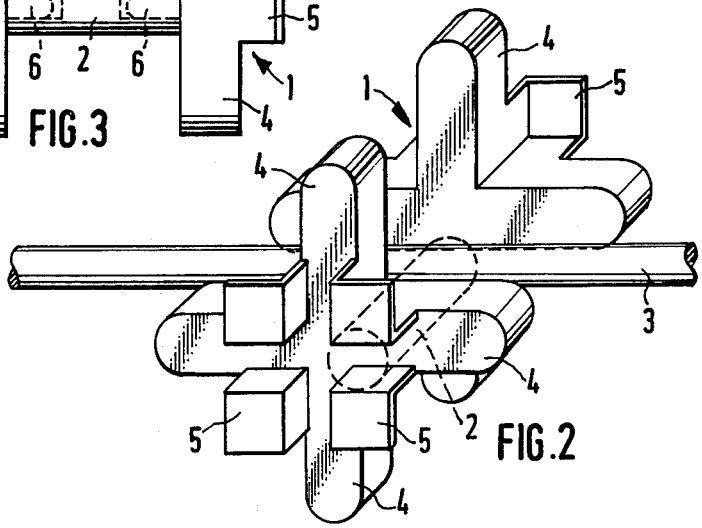
Figure 4:
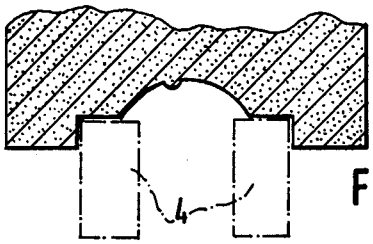
Figure 5:
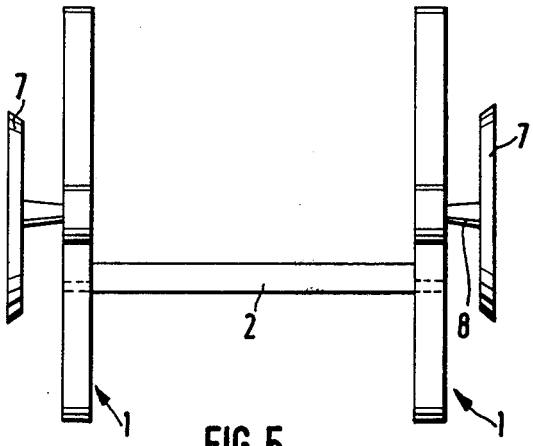
Figure 7:
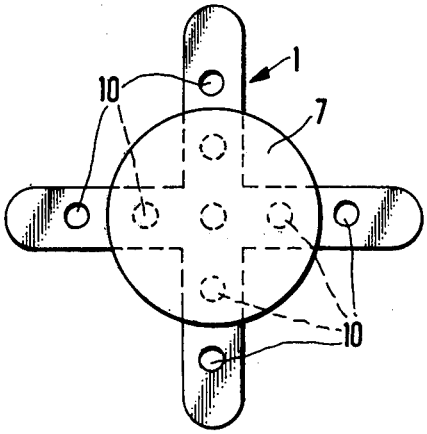
Figure 6:
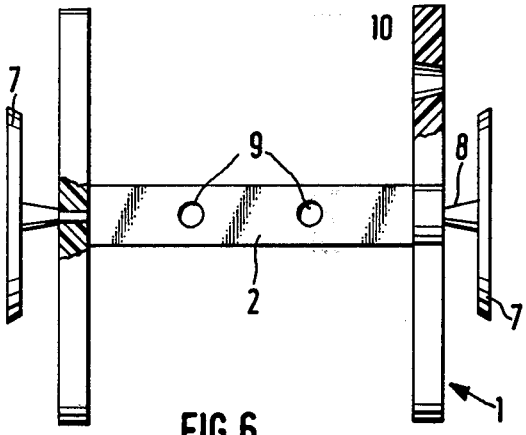

Additional features and advantages of the invention will become apparent from the following detailed description of several embodiments of the spacer member according to the invention and with reference to the accompanying drawings in which:

FIG. 1 is a perspective view of a first embodiment of the spacer member according to the invention, FIG. 2 is a perspective view of a second embodiment of the spacer member according to the invention, FIG. 3 is a side view of the spacer member according to FIG. 2, FIG. 4 shows a further arrangement of the spacer member corresponding to FIG. 3 with grooved wall elements and, FIGS. 5 – 7 show a third embodiment of the spacer member according to the invention respectively in an elevation view, a plan view and a side view.

As may be seen from FIGS. 1 and 2 each spacer member consists of two cross elements 1 which are disposed in two planes that are parallel to each other. The two cross elements are connected by a web 2 which is arranged either centrally as in FIG. 1 or opposite the intersecting points of the arms of the cross elements 1 in an offset relationship as seen in FIG. 2. This web 2 may serve also as support element for an iron reinforcing bar 3 which can be inserted between the wall elements, especially glass bricks.

Each of the cross elements 1 consists of two arms 4 standing vertically on each other. In order to be able to use these spacer members also for the first and last layer or along the side one uses T-elements instead of cross elements.

The width of the arms 4 corresponds to the desired joint width between the wall elements or glass bricks. The distance of the outer surfaces of the cross-elements or T-elements from each other is less by at least double the joint depth than the thickness of the wall elements used for constructing the wall.

In case the wall elements are provided with a groove extending along the side surfaces, and whose walls are either parallel or perpendicular to the joint surfaces, or present centering steps in connection with the joint surfaces, the spacer member may be exclusively in contact with these surfaces. The width of the arms of the cross-elements or T-elements must correspond in that case to the width of the joint plus the double groove depth or step height, as seen in FIG. 4.

In order to line up the wall elements exactly to each other also in the vertical direction break-off vanes are provided as shown in the embodiment of FIG. 2, and their vertical parts enclose also the outer surfaces of the wall elements as shown in dash lines in FIG. 3.

These break-off vanes are connected to the arms of the cross-elements or T-elements and are provided with breaker lines so that they may be easily broken off after a short period, namely as soon as the mortar has hardened a little.

The embodiment according to FIGS. 5 through 7 differs from that of FIGS. 2 and 3 merely in the fact that in place of the break-off vanes 5 each cross-element or T-element 1 is provided with a disc 7 which is spaced by means of a projection 8 relative to the wall element. This disc 7 is integral with the projection 8 and may be separated from the cross-element or T-element, and this is done for manufacturing reasons. In order to receive vertical reinforcing bars (not shown) the web 2 is provided with openings 9. There are also openings 10 in the cross-elements or T-elements 1 and they provide on the one hand a saving of material and improve on the other hand the anchoring of the spacer member in the joint material.

It is particularly necessary in the embodiment of FIG. 2 that the spacer member is exactly adjusted to the wall element thickness. For this purpose each of the cross-elements or T-elements is provided with a projection 6, for example of cylindrical form, by means of which the two elements 1 may be connected through a sleeve-like web 2. By means of sleeve-like webs 2 of varying lengths the spacer members may be adapted easily to the thickness of the wall elements to be used.

In order to prevent a turning of the two cross-elements or T-elements relative to each other these elements may be provided with two projections 6 so that two webs 2 instead of one may be attached. It is obvious that the spacer member of the invention may be manufactured also either as a one piece or a two-piece member.

It has been found that it is useful to provide the outer surfaces of the cross-elements or T-elements with a rough surface so that the joint mass can combine also with the spacer member.

In order to prevent a working of the spacer members in the finished wall structure they consist of a material which is essentially non-expandable in water and preferably of a synthetic material which is provided with filler material.

What is claimed is:

1. In a wall construction including a plurality of bricks arranged in layers to lie above each other with space between the top and bottom surfaces and the end surfaces of adjacent bricks for receiving mortar, and reinforcing bars placed between layers of the bricks, a wasted spacer member receivable between the corners of said bricks for mounting the bricks in correctly spaced relationship to receive mortar and to support said reinforcing bars in proper position, said spacer member including: a pair of elements each carrying vertical and horizontal arms lying in a common plane and which are rectangular in cross section, said elements being arranged parallel to each other in spaced relationship with the intersecting points of the arms of both elements lying on a common axis perpendicular to the planes of the elements; at least one web extending between and connecting said pair of arm-carrying elements, so that the distance between the outer surfaces of said elements is smaller than the thickness of said bricks to be spaced thereby, said web being offset relative to said common axis passing through said intersecting points of said arms and constituting a support for a reinforcing bar placed between layers of said bricks, the surface of the web facing the intersecting points of the arms of the arm-carrying elements being offset by about half the reinforcing bar diameter relative to the common axis passing through said intersecting points, said vertical and horizontal arms of said elements having a thickness such that the bricks to be spaced thereby are in proper relationship to receive mortar when the side surfaces of said arms are in engagement with the confronting surfaces of said bricks; and outwardly projecting, removable vane means carried by said arm-carrying elements for enclosing the corners of the bricks.

2. In a wall construction according to claim 1, wherein each vane means includes a disc disposed outwardly of its associated arm-carrying element, and which lies in a plane parallel to the plane of the element.

3. In a wall construction according to claim 2, wherein the distance between the discs on opposite sides of the spacer member corresponds to the thickness of the bricks.

4. In a wall construction including a plurality of bricks arranged in layers to lie above each other with space between the top and bottom surfaces and the end surfaces of adjacent bricks for receiving mortar, and reinforcing bars placed between layers of the bricks, a wasted spacer member receivable between the corners of said bricks for mounting the bricks in correctly spaced relationship to receive mortar and to support said reinforcing bars in proper position, said spacer member including: a pair of elements each carrying vertical and horizontal arms lying in a common plane, said elements being arranged parallel to each other in spaced relationship with the intersecting points of the arms of both elements lying on a common axis perpendicular to the planes of the elements; and at least one web extending between and connecting said pair of arm-carrying elements, so that the distance between the outer surfaces of said elements is smaller than the thickness of said bricks to be spaced thereby, said web being offset relative to said common axis passing through said intersecting points of said arms and constituting a support for a reinforcing bar placed between layers of said bricks, said vertical and horizontal arms of said elements having a thickness such that the bricks to be spaced thereby are in proper relationship to receive mortar when the side surfaces of said arms are in engagement with the confronting surfaces of said bricks, and each arm-carrying element being provided with a disc disposed outwardly thereof, and which lies in a plane parallel to the plane of the element, the distance between the discs on opposite sides of the spacer member corresponding to the thickness of the bricks, and each disc being spaced by means of a projection from its corresponding arm-carrying element.

5. In a wall construction according to claim 4, wherein the projection is carried by the disc, and is releasably connected to the arm-carrying element.

6. In a wall construction according to claim 4, wherein the web has vertically extending openings therethrough for receiving vertically disposed reinforcing bars.

7. In a wall construction according to claim 4, wherein said bricks have grooves formed in at least some of said end surfaces and said top and bottom surfaces thereof, and wherein the arms of said elements engageable within said grooves have a width equal to the width of the mortar joint, plus the sum of the groove depths in two adjacent brick surfaces.

8. In a wall construction according to claim 4, wherein the arm-carrying elements have a rough outer surface.

9. In a wall construction including a plurality of bricks arranged in layers to lie above each other with space between the top and bottom surfaces and the end surfaces of adjacent bricks for receiving mortar, and reinforcing bars placed between layers of the bricks, a wasted spacer member receivable between the corners of said bricks for mounting the bricks in correctly spaced relationship to receive mortar and to support said reinforcing bars in proper position, said spacer member including: a pair of elements each carrying vertical and horizontal arms lying in a common plane, said elements being arranged parallel to each other in spaced relationship with the intersecting points of the arms of both elements lying on a common axis perpendicular to the planes of the elements; a cylindrical projection on the inner side of each of said arm-carrying elements; and at least one web extending between and connecting said pair of arm-carrying elements, so that the distance between the outer surfaces of said elements is smaller than the thickness of said bricks to be spaced thereby, said web being offset relative to said common axis passing through said intersecting points of said arms and constituting a support for a reinforcing bar placed between layers of said bricks, said vertical and horizontal arms of said elements having a thickness such that the bricks to be spaced thereby are in proper relationship to receive mortar when the side surfaces of said arms are in engagement with the confronting surfaces of said bricks, and said web comprising a sleeve-like member, the opposite ends of said sleeve-like member receiving said cylindrical projections to connect said arm-carrying elements in spaced apart relationship.

10. In a wall construction according to claim 9, wherein the opposite ends of said sleeve-like member engage the inner surfaces of said arm-carrying elements to thereby establish the spacing therebetween, the length of said sleeve-like member being selected to be compatible with the width of the bricks.

11. In a wall construction including a plurality of glass bricks or the like arranged in layers to lie above each other with space between the top and bottom surfaces and the end surfaces of adjacent bricks for receiving mortar, the mating surfaces of said bricks each having a pair of supporting surfaces thereon extending along and adjacent to their front and rear edges, a wasted spacer member receivable between the corners of said bricks for mounting the bricks in correctly spaced relationship to receive mortar, said spacer member including: a pair of elements each carrying vertical and horizontal arms lying in a common plane, said elements being arranged parallel to each other in spaced relationship with the intersecting points of the arms of both elements lying on a common axis perpendicular to the planes of the elements; at least one web extending between and connecting said pair of arm-carrying elements, so that the distance between the outer surfaces of said elements is smaller than the thickness of said bricks to be spaced thereby but substantially greater than the minimum distance between the pairs of said supporting surfaces associated therewith, said vertical and horizontal arms of said elements having a thickness such that the bricks to be spaced thereby are in proper relationship to receive mortar when the side surfaces of said arms are in engagement with the confronting surfaces of said bricks; and outwardly projecting, removable vane means carried by each of said arm-carrying elements for enclosing the corners of the bricks, each vane means including at least one surface spaced from and extending parallel to its associated arm-carrying member, the distance between the vane means surfaces on opposite sides of the spacer member corresponding to the thickness of the bricks.

12. In a wall construction according to claim 11, wherein the web constitutes a support for an iron reinforcing bar placed between layers of bricks.

13. In a wall construction according to claim 11, wherein the arm-carrying elements have a rough outer surface.

14. In a wall construction according to claim 11, wherein the two arm-carrying elements are joined through connecting members to the web.

15. In a wall construction according to claim 11, wherein the arms have a rectangular cross-section.

16. In a wall construction according to claim 11, wherein said spacer member is made of a material which is substantially non-expandable in water, preferably of a synthetic material including filler substances.

17. In a wall construction according to claim 11, wherein said arm-carrying elements are T-shaped.

18. In a wall construction according to claim 11, wherein said arm-carrying elements are cross-shaped.

19. In a wall construction according to claim 11, wherein said vane means are connected to said arm-carrying elements by frangible connecting portions.

20. In a wall construction according to claim 11, wherein said vane means are connected to said arm-carrying elements by projections carried by said vane means and releasably connected to said elements.

21. In a wall construction according to claim 11, wherein said vane means comprise separate projections carried by each arm-carrying member, one for each corner of the bricks meeting at said wasted spacer member, said separate projections having wall means on their outer ends which define said vane means surfaces.

22. In a wall construction according to claim 11, wherein said vane means surfaces are formed by discs joined to their respective arm-carrying members by a generally cylindrical projection.

* * * * *